US005295821A

United States Patent [19]

Daukss

[11] Patent Number: 5,295,821

[45] Date of Patent: Mar. 22, 1994

[54] FOUNDRY SAND THERMAL RECLAMATION SYSTEM AND METHOD

[76] Inventor: Karlis N. Daukss, 32704 N. Roundhead Dr., Solon, Ohio 44139

[21] Appl. No.: 908,478

[22] Filed: Jul. 6, 1992

[51] Int. Cl.[5] ..... F27B 15/00

[52] U.S. Cl. ..... 432/103; 432/105; 432/111

[58] Field of Search ..... 432/103, 105, 106, 107, 432/111, 114

[56] References Cited

U.S. PATENT DOCUMENTS

| | | | |
|---|---|---|---|
| 3,817,697 | 6/1974 | Parobek | 432/105 |
| 3,916,807 | 11/1975 | Eiki | 432/105 |
| 4,427,376 | 1/1984 | Etnyre et al. | 432/111 |
| 4,439,141 | 3/1984 | Deckebach | 432/14 |
| 4,507,081 | 3/1985 | Deve | 432/106 |
| 4,573,417 | 3/1986 | Deve | 110/236 |
| 5,100,314 | 3/1992 | Rierson | 432/103 |

OTHER PUBLICATIONS

Sand Systems, Inc., GR Kalciner Model II (Distributed Prior to Jul. 3, 1991).

*Primary Examiner*—Henry C. Yuen
*Attorney, Agent, or Firm*—Renner, Otto, Boisselle & Sklar

[57] ABSTRACT

A thermal treatment system and method characterized by an outer drum mounted on the base for rotation about a rotational axis; an inner drum mounted coaxially within the outer drum closer to a heater end thereof than an inlet end of the outer drum, the inner and outer drums forming therebetween an annular flow passage surrounding the inner drum; a passage at a heater end of the inner drum for allowing material to drop from the inner drum into the outer drum for flow through the annular flow passage from its inlet end to its outer end; material conveying structure for conveying material within a feed tube from the inlet end of the outer drum to the inner drum for deposit within the interior of the inner drum at its inlet end, the feed tube being mounted coaxially within the outer drum and being spaced radially inwardly from the annular wall of the outer drum to form an annular flow passage surrounding the feed tube that has an inlet end connected to the outlet end of the annular passage surrounding the inner drum and a cross-sectional area greater than the cross-sectional area of the annular passage surrounding the inner drum; a burner for generating and feeding hot gases into the inner drum for contacting with material fed into the inner drum by the material conveying structure thereby to thermally treat the material, the hot gases flowing through the inner drum, then through the annular passage surrounding the inner drum and then through the annular passage surrounding the feed tube; and an outlet for exhausting the hot gases and discharging thermally treated material from the outlet end of the annular passage surrounding the feed tube.

21 Claims, 6 Drawing Sheets

FOUNDRY SAND THERMAL RECLAMATION SYSTEM AND METHOD

The invention herein described relates generally to systems and methods for thermally treating solid, granular and aggregate materials and, more particularly, to a system and method for reclaiming spent chemically bonded and/or clay bonded foundry sands. Because the invention was conceived and developed for thermal reclamation of spent foundry sands containing organic or clay binders, and is particularly useful for such, it will be described herein chiefly in this context. However, the invention in its broader aspects could be adapted to thermal treatment of a variety of solid, granular and aggregate materials including, for example, thermal remediation of soils containing organic contaminates, calcining in general, ore roasting, etc.

BACKGROUND

Various prior art attempts have been made to treat material by thermal reclamation and, in particular, foundry sand. The advantages of reclaiming foundry sand are well known. One advantage is the reduction in the need for virgin foundry sand. In addition, the ability to reclaim used foundry sand obviates the problem associated with the need to find a suitable disposal site for the used foundry sand.

A need exists for a foundry sand reclamation system and method that overcome drawbacks and limitations or prior art foundry sand reclamation systems and methods. Principally, there is a need for such a system and method that provides high production output at low cost with high reliability and efficiency.

SUMMARY OF THE INVENTION

The present invention provides a thermal treatment system and method which satisfies the aforesaid need and which may have more general application in the thermal treatment of solid, granular and aggregate materials. Briefly, the system and method are characterized by a base; an outer drum mounted on the base for rotation about a rotational axis and having an inlet end, a heater end and an annular wall extending between the inlet and heater ends; an inner drum mounted coaxially within the outer drum closer to the heater end than the inlet end of the outer drum, the inner drum having an inlet end, a heater end and an annular wall extending between the inlet and heater ends, the annular wall being spaced radially inwardly from the annular wall of the outer drum to form an annular flow passage surrounding the inner drum, the annular flow passage surrounding the inner drum having an inlet end and an outlet end; passage means at the heater end of the inner drum for allowing material to drop from the inner drum into the outer drum for flow through the annular flow passage from its inlet end to its outer end; means for rotating the outer and inner drums with respect to the base; material conveying means for conveying material from the inlet end of the outer drum to the inner drum for deposit within the interior of the inner drum at its inlet end, the material conveying means including a feed tube through which the material is fed, the feed tube being mounted coaxially within the outer drum and extending from the inlet end of the outer drum to the inlet end of the inner drum, the feed tube being spaced radially inwardly from the annular wall of the outer drum to form an annular flow passage surrounding the feed tube, the annular flow passage surrounding the feed tube having an inlet end connected to the outlet end of the annular passage surrounding the inner drum, an outlet end, and a cross-sectional area greater than the cross-sectional area of the annular passage surrounding the inner drum; means for generating and feeding hot gases into the inner drum for contacting with material fed into the inner drum by the material conveying means thereby to thermally treat the material, the hot gases flowing through the inner drum, then through the annular passage surrounding the inner drum and then through the annular passage surrounding the feed tube; and outlet means for exhausting the hot gases and discharging thermally treated material from the outlet end of the annular passage surrounding the feed tube.

According to a preferred embodiment of the invention, the material conveying means includes a feed screw extending through the feed tube substantially along the length of the feed tube, and the feed screw and feed tube are coupled for rotation with the outer and inner drums. The system also preferably comprises a hopper having a discharge chamber at its bottom end located at an inlet end of the feed tube, and the feed screw extends into the discharge chamber for capturing material for transport along the feed tube to the inner drum. Preferably, the feed screw has a first section axially coextensive with the discharge chamber and a second section axially coextensive with the feed screw. the second section has a fixed pitch length and an outer diameter substantially the same as the inner diameter of the feed tube which preferably is of circular cross-section, and the first section has a pitch length less than the pitch length of the second section and an outer diameter less than the outer diameter of the second section. Also preferably, the inner drum has at its inlet end an inlet end wall having a center opening, and the feed tube extends through and has a fit within the center opening that permits at least limited relative axial movement.

Further in accordance with a preferred embodiment of the invention, the means for generating and feeding hot gases into the inner drum includes a hot gas tube extending coaxially into the inner drum from the heater end of the drum for directing the hot gases into the inner drum. The hot gas tube preferably extends at least halfway into the inner drum.

According to another aspect of the invention, the feed tube is coupled for rotation with the outer and inner drums and has attached thereto a plurality of circumferentially and axially spaced apart, radially outwardly extending flights or blades having material engaging surfaces for contacting the material flowing through the annular passage surrounding the feed tube as the flights rotate around the axis of the feed tube. The blades have material engaging surfaces thereof sloped relative to a plane perpendicular to the axis of the feed tube. The blades and feed tube function to extract heat from the hot gases and material flowing through the annular passage surrounding the feed tube and transfer it to material being fed through the feed tube to the inner drum. A plurality of blades also are provided on the inner drum both interiorly and exteriorly, although in the former instance the blades extend radially inwardly for contacting the material flowing through the inner drum as the blades rotate around the axis of the inner drum. Some of the blades function as paddles having material engaging surfaces oriented parallel to the axis of the feed tube whereas others function as vanes having material engaging surfaces sloped relative to a plane perpendicular to the axis of the inner drum. The paddles and/or vanes preferably have at their radially outer ends lips projecting forwardly of the material engaging surfaces for capturing material as the paddles and/or vanes rotate. The paddles and vanes preferably are circumferentially spaced apart in respective circumferential rows axially spaced apart along the axis of the feed tube, and more preferably at least one circumferential row of paddles is axially disposed between relatively adjacent rows of vanes with the vanes sloped to retard flow of material through the annular space surrounding the feed tube during rotation of the outer and inner drums.

A preferred embodiment of the invention also is characterized by the outlet means including a plurality of circumferentially spaced apart outlet openings in an outlet section of the outer drum, and an exhaust hood surrounding the outlet section and within which the outlet section relatively rotates. The exhaust hood includes a gas discharge port and a bottom material discharge port.

Provision also is made for transfer of waste heat from hot gases exiting the outlet means to air being supplied to the heater means which preferably is a gas burner which produces hot gases in the heater tube.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1A:
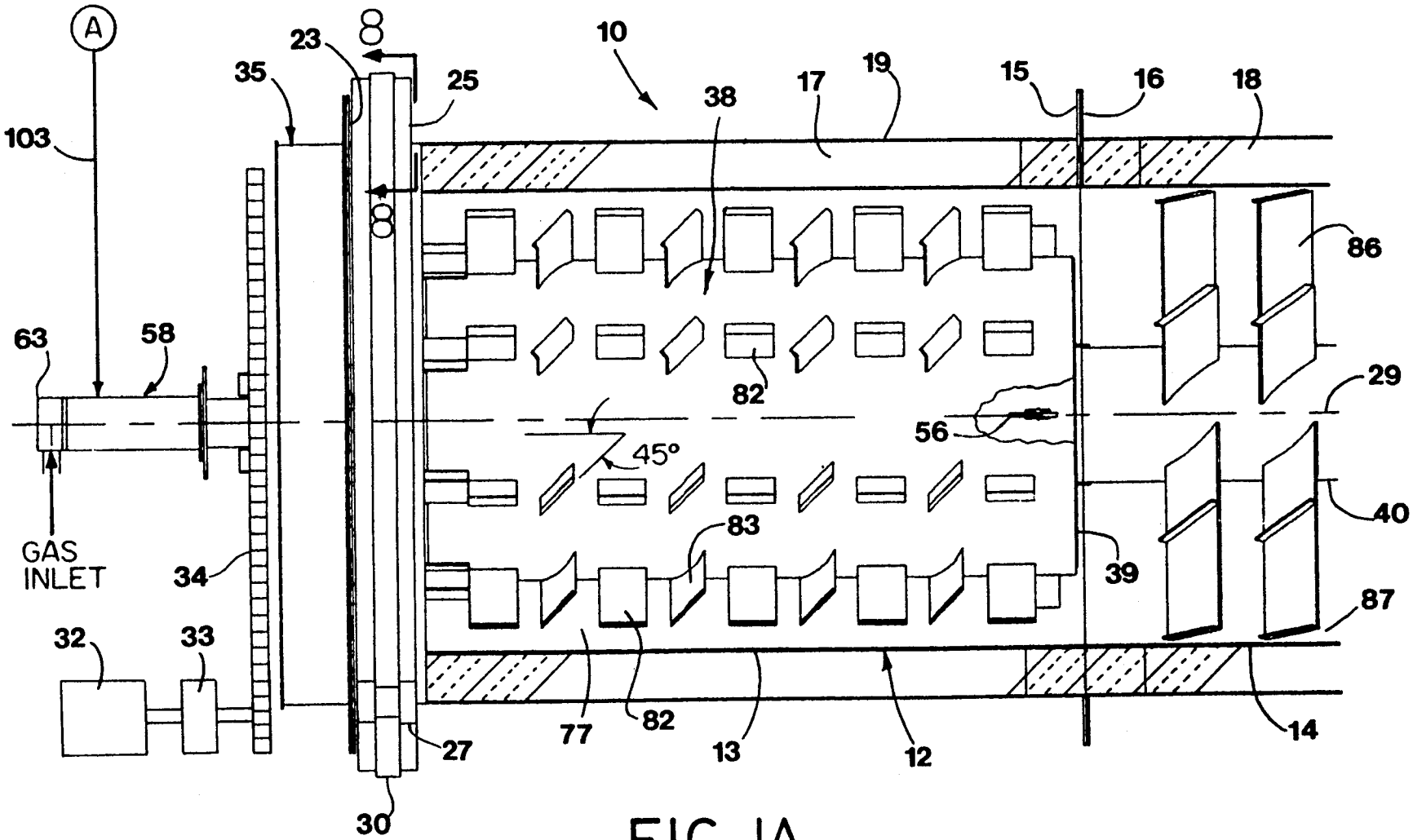
FIGS. 1A and 1B (together herein referred to as FIG. 1) are broken continuations of a cross-sectional view of a thermal treatment system according to the invention.

Referring now in detail to the drawings and initially to FIG. 1, a system constructed in accordance with the invention is designated generally by reference numeral 10. The system 10 is primarily designed to be utilized for purposes of effecting thermal reclamation of used foundry sand of the kind which contains organic matter or other material that may be broken down through thermal treatment thereby to render the foundry sand reusable.

The system 10, herein also referred to as the thermal treatment or reclamation system, comprises an outer containment vessel or drum 12. In the illustrated preferred embodiment, the outer drum is fabricated from a pair of axially juxtaposed cylinders 13 and 14 preferably of the same diameter. At their axially juxtaposed ends, the cylinders 13 and 14 have respective flanges 15 and 16 that are joined together by circumferentially spaced apart bolts (not shown) and corresponding nuts (not shown), or other suitable fasteners that preferably are removable to permit disassembly of the drum 12 for maintenance and/or repair purposes. For heat retention purposes, each cylinder 13, 14 has wrapped therearound one or more layers of insulation material 17, 18 which may be suitably anchored by conventional means to the cylinders and surrounded by an outer protective skin 19, 20.

The cylinders 13 and 14 have at their outer ends flanges 23 and 24. The flanges 23 and 24 are mounted to riding rings 25 and 26 respectively. The riding rings are supported in cradle-like fashion by respective pairs 27 and 28 of transversely spaced apart rollers as is further illustrated in FIG. 5. In this manner the outer drum is supported for rotation about its longitudinal axis 29. One pair 27 of the rollers is grooved to receive an annular rib 30 on the corresponding riding ring 25 to prevent axial shifting of the outer drum at one end thereof, herein termed the heater end. The rollers of the other pair 28 and corresponding riding ring 26 are otherwise configured to accommodate limited axial shifting of the opposite end of the outer drum, herein termed the feed or inlet end, to accommodate thermal expansion and contraction of the outer drum relative to the fixed axial spacing between the two sets of rollers. The rollers may be mounted to a suitable base or framework structure schematically indicated at 31 in FIG. 5 to which the various other components of the system may directly or indirectly mounted to provide an overall system unit.

The outer drum 12 is rotated by an electric motor 32, although other suitable drive means may be employed as well. The motor 32 is coupled through a speed reducer 33 to a drive sprocket 34 by a drive chain. The drive sprocket 34 is bolted to a heater drum end assembly 35 which in turn is removably attached to the heater end flange 23 by suitable fasteners such as bolts (not shown) and corresponding nuts (not shown).

In a manner described in further detail below, the heater drum end assembly 35 has fixedly mounted thereto the heater end of an inner drum 38. Accordingly, the inner drum will be rotated along with the outer drum. As shown, the inner drum preferably is concentric with the outer drum and is housed within the left hand cylinder 13 of the outer drum, as viewed in FIG. 1A.

Figure 1B:
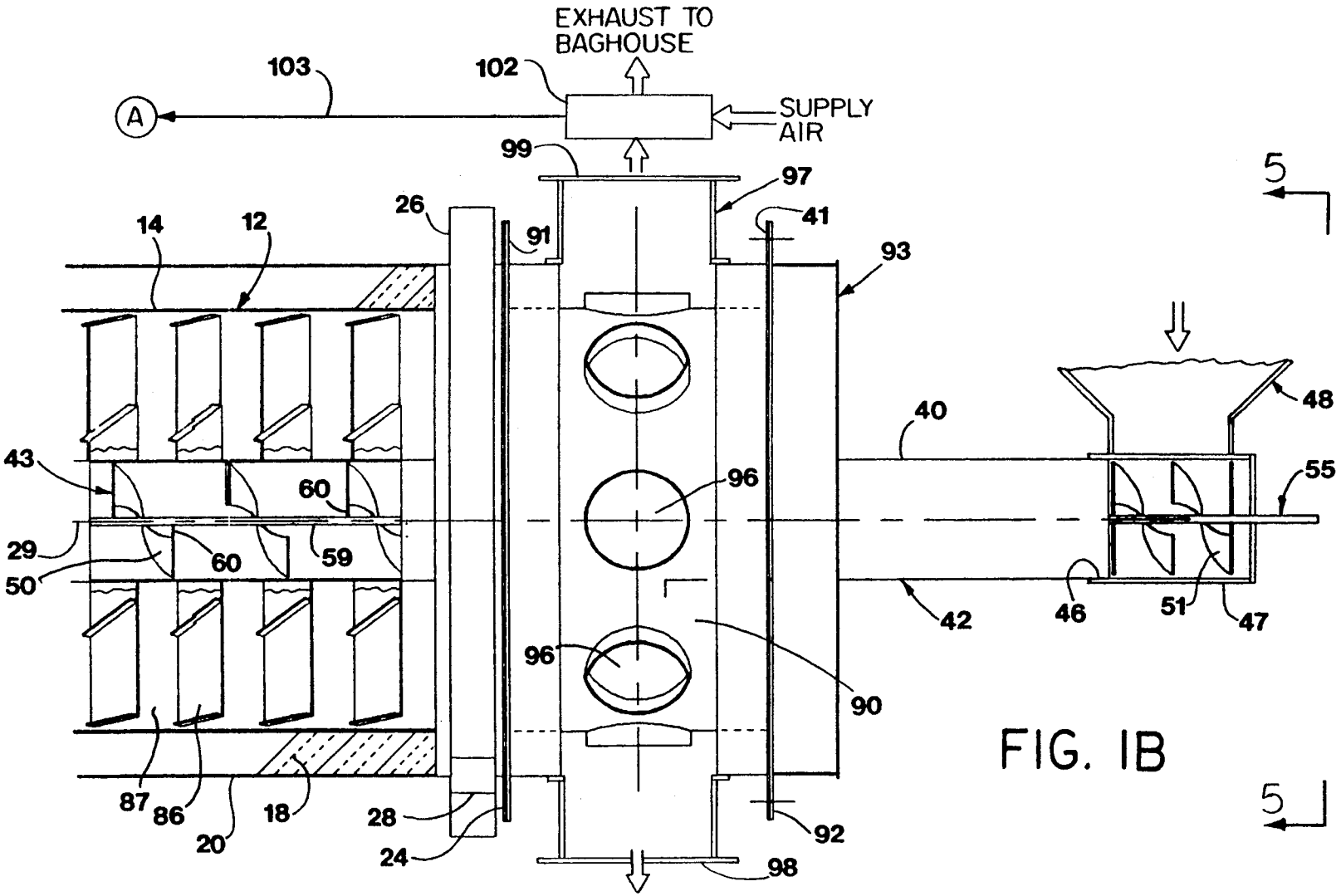
Figure 2:
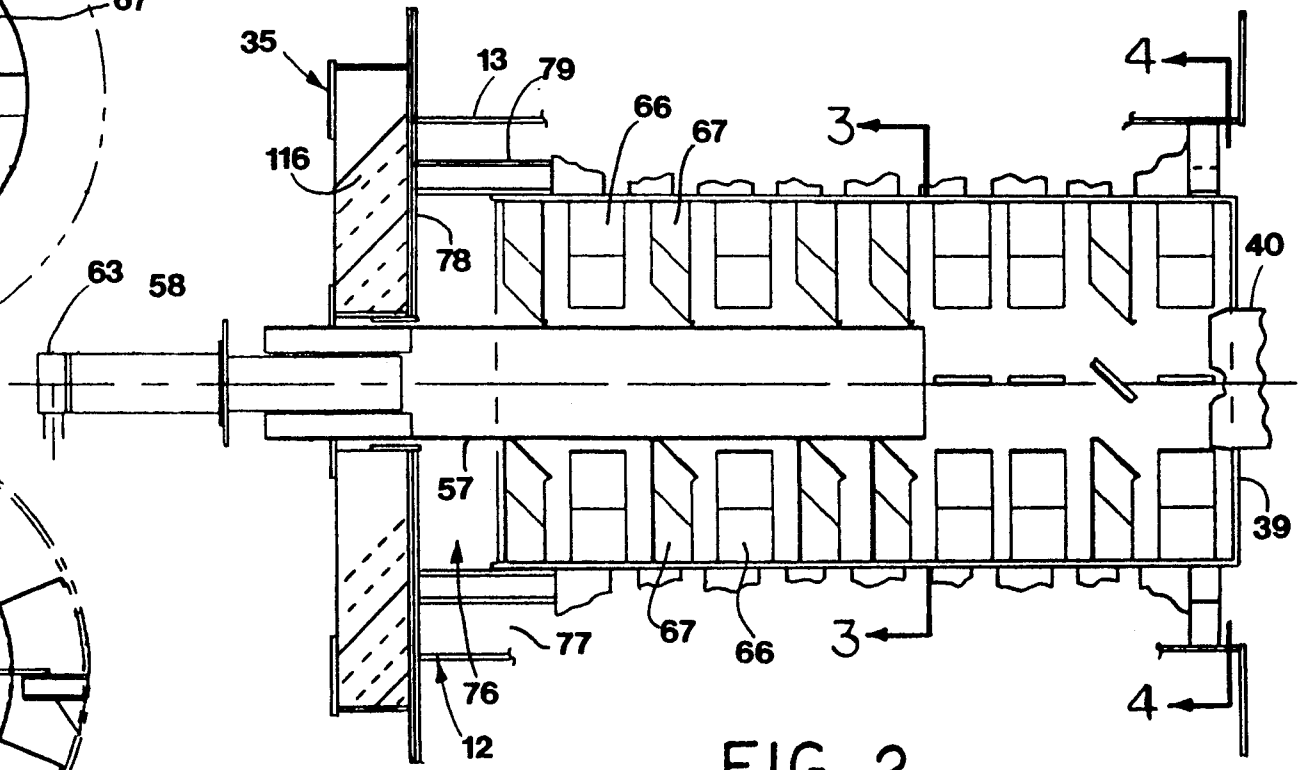
FIG. 2 is a cross-sectional view showing the interior of the inner drum of the system.

At its opposite or inlet end, to the right in FIGS. 1A and 2, the inner drum 38 is closed by an end wall 39. The end wall 39 has a center opening into which the end of a center feed tube 40 is slip fitted. The feed tube, as well as the opening in the end wall 39, preferably is circular in cross-section and has a diameter considerably less than the diameter of the inner drum. In this manner, the inner drum 38 supports the outlet end of the feed tube 40 which, as shown at the right in FIG. 1B, is fixedly mounted near its inlet end an end outlet section flange 41 at the expansion end of the outer drum in the hereinafter described manner. The slip fit provided between the inner drum end wall 39 and the outlet end of the feed tube 40 accommodates relative thermal expansion and contraction of the inner drum and feed tube as may occur during heat up and cool down of the system. The outlet end of the feed tube may be tapered as shown in FIG. 2 to facilitate insertion of the feed tube into the opening in the end wall of the inner drum during assembly of the system.

The feed tube 40 functions as the outer housing of a screw conveyor 42. The screw conveyor 42 further includes a ribbon screw 43 which is fixedly attached to the feed tube for rotation therewith during rotation of the outer and inner drums. That is, the screw, feed tube, inner drum and outer drum together rotate as a unit.

At its inlet end, the feed tube 40 extends into an outlet port 46 of a discharge chamber 47 at the bottom of a hopper 48 which is used to hold a supply of unreclaimed sand or other material to be thermally treated. The feed tube is free to rotate in the outlet port and preferably a close fit or suitable seal is provided to prevent sand from escaping through any gap between the tube and surrounding structure of the outlet port.

Figure 5:
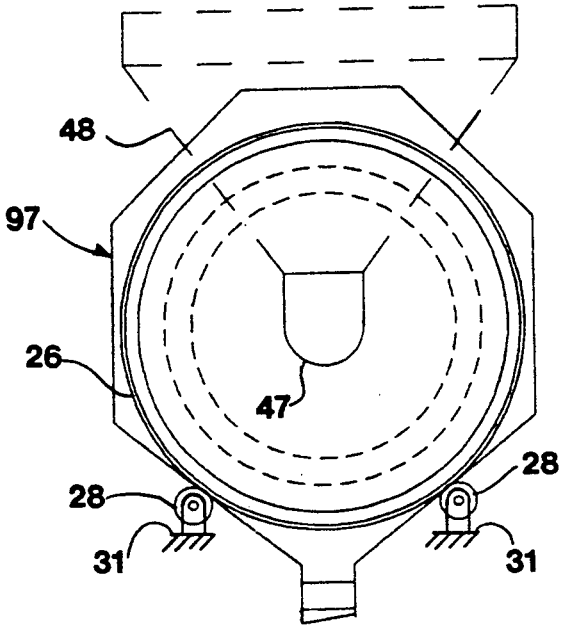
FIG. 5 is an end elevational view of the system taken from the line 5—5 of FIG. 1B.

As seen at the right in FIG. 1B, the screw extends beyond the end of the feed tube 40 and into the bottom discharge chamber 47 of the hopper 48 which has a semicircular bottom wall concentric with the longitudinal axis of the screw as further illustrated in FIG. 5. As is preferred, the section 50 of the screw 43 axially coextensive with the feed tube is of uniform pitch and has a diameter closely corresponding to the inner diameter of the feed tube. The screw also has a smaller radius double pitched section 51 which protrudes from the end of the feed tube into the bottom discharge chamber 47. This latter section 51 functions to slowly pull the sand into the feed tube thereby to avoid excessive pressure from being generated in the feed tube.

The feed screw 43 supports internally thereof an axially extending temperature probe 55 which protrudes beyond the end of the feed tube and into the interior of the inner drum 38. At its terminal end there is provided a thermocouple 56 (FIG. 1A) or other suitable sensing device for sensing the temperature of hot gases at a point proximate the feed end of the inner drum and coaxially aligned with the heater tube 57 (FIG. 2) of a gas heater assembly 58. The thermocouple leads extend from the thermocouple through a relatively small diameter tube 59 which is attached by attachment lugs 60 to the inner edges of the screw flights at axially spaced apart locations along the length of the screw. The tube 58 protrudes axially beyond the feed end of the feed screw and out through an end wall of the bottom hopper discharge chamber 47, wherefrom the thermocouple leads may be appropriately routed to a system control unit for use in monitoring and controlling system operation.

The heater tube 57 protrudes from the heater end of the outer drum 12 and has coupled thereto a gas burner 63 of any suitable type, but it will be appreciated that other types of heating devices may be employed although presently a natural gas burner is generally the most economical. Conventional means are provided for controlling the supply of air to the burner so as to maintain an oxidizing atmosphere and minimum free oxygen in the hot gases generated thereby for maximum thermal efficiency. The hot gases from the burner flow through the heater tube 57 and into the interior of the inner drum 38. The heater tube preferably projects into the drum more than halfway so as to direct the hot gases to the inlet end of the inner drum thereby to maximize the time of exposure of sand to the high temperature gases exiting from the heater tube. The heater tube also provides heat transfer by radiating energy to the sand at a high rate to heat the sand quickly. Typical process temperatures will range from 800° F. (425° C.) to 1500° F. (815° C.) depending on system requirements.

As shown in FIG. 2, the inner drum 38 has attached to the interior wall surface thereof a plurality of flights or blades which extend radially inwardly from the drum wall for engaging material fed into the inner drum by the screw conveyor 42. In the illustrated embodiment there are two different types of blades herein designated paddles 66 and vanes 67. The paddles 66 and vanes 67 are essentially the same except that the paddles 66 have generally planar material engaging surfaces oriented perpendicular to the axis of the inner drum. On the other hand, the vanes 67 have generally planar material engaging surfaces sloped in relation to a plane perpendicular to the axis of said inner drum. As shown, the paddles and vanes are arranged in respective circumferential rows that are axially spaced apart along the inner drum.

Figure 3:
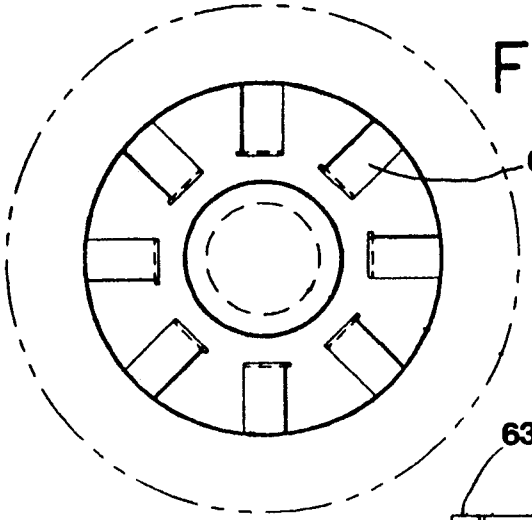
FIG. 3 is a cross-sectional view of the inner drum taken substantially along the line 3—3 of FIG. 2.
Figure 4:
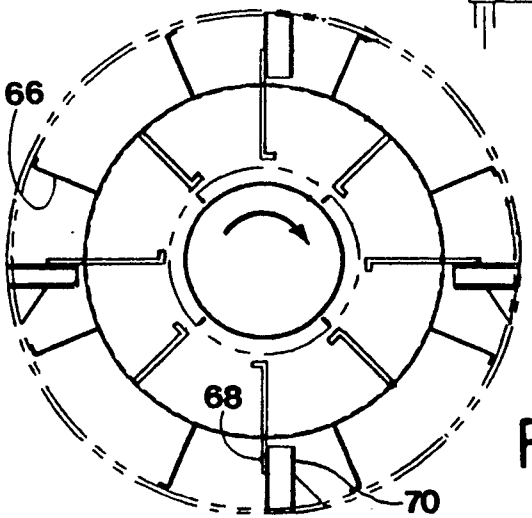
FIG. 4 is a cross-sectional view of the inner drum taken substantially along the line 4—4 of FIG. 2.

The circumferential arrangement of the blades is illustrated further in FIGS. 3 and 4. As further shown in FIG. 4, the inlet end of the inner drum is supported by radially extending ears 68 on struts 70 extending radially inwardly from the outer drum. The ears 68 rest on the struts so that the inner drum may be easily axially withdrawn from the outer drum upon detachment of the end wall assembly 35 from the outer drum flange 23.

The paddles and vanes 66 and 67 preferably extend radially inwardly to a point just short of contacting the heater tube 57. At their radially inner ends, the paddles and vanes preferably are each provided with a lip 69 which functions, during rotation of the inner drum, to capture and lift sand as the blade rotates upwardly. As the blades rotate upwardly after passing through sand in the bottom of the inner drum, the sand will fall back away from the lips and cascade down through the gas stream. This lifting function is primarily performed by the paddles whereas the vanes primarily function, because of their orientation, to retard flow of material through the inner drum to increase the residence time of the material flowing in the inner drum from right to left in FIG. 1.

Figure 6:
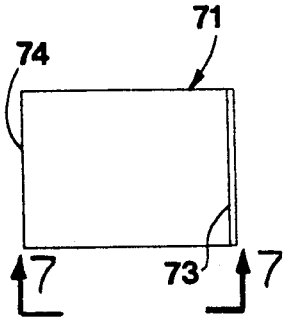
FIG. 6 is a plan view of a representative blade used in the system.
Figure 7:
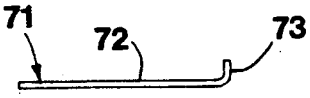
FIG. 7 is an edge view of the blade of FIG. 6.

In FIGS. 6 and 7, a representative blade is designated generally by reference numeral 71. The blade 71 is representative of both the paddles 66 and vanes 67, which primarily differ by reason of their orientation relative to the axis of the inner drum as above described. As shown, the blade 71 has a material engaging surface 72 and a forwardly protruding lip 73 at its radially outer end. The radially inner edge 74 of the blade is suitably configured for welding to the surface of the inner drum 38. For the paddles 66 a straight radially inner edge is sufficient. For the vanes, however, it is preferable to provide a slightly convex radially inner edge 74 to better match the radius of the inner wall surface of the inner drum 38. As is discussed further below, the same type of blade is attached to the outer diameter wall surface of the inner drum, in which case the radially inner edge of the blade may be slightly convex to facilitate welding of the blade to the drum. Also, similar but radially longer blades are attached as by welding to the outer diameter surface of the feed tube 40, in which case the radially inner edge of the vanes can again be slightly concave to facilitate welding whereas again the radially inner edge of the paddles may be straight.

At the heater end of the inner drum 38, as shown at the left in FIG. 2, there is provided an annular outlet passage 76 for allowing material to drop from the inner drum 38 into the outer drum 12 for counterflow through an annular flow passage 77 formed between the larger diameter inner surface of the outer drum and the smaller diameter outer surface of the inner drum. In the illustrated preferred embodiment, the annular outlet passage is formed between the heater end of the inner drum and an end wall 78 closing the heater end of the outer drum. The inner drum is mounted to the end wall by a circumferential arrangement of brackets 79 which hold the inner drum axially spaced away from the end wall to form the annular outlet passage 76.

As shown in FIG. 1A, the inner drum 38 has attached to the exterior wall surface thereof a plurality of flights or blades 82 and 83 which extend radially outwardly from the drum wall for engaging material flowing through the annular flow passage surrounding the inner drum. Again there preferably are two different types of blades herein designated paddles 82 and vanes 83 that are similar in shape and function to the paddles and vanes 66 and 67 within the inner drum. The paddles 82 have generally planar material engaging surfaces oriented perpendicular to the axis of the inner drum. On the other hand, the vanes 83 have the generally planar material engaging surfaces sloped in relation to a plane perpendicular to the axis of the inner drum. As shown, the paddles and vanes are arranged in respective circumferential rows that are axially spaced apart along the inner drum.

The blades preferably extend radially outwardly to a point just short of contacting inner diameter wall surface of the outer drum 12. At their radially outer ends, the blades and especially the paddles preferably are provided with lips which function during rotation of the inner drum to capture and lift sand as the blades rotate upwardly after passage through material in the lower region of the annular passage 77. As the paddle continues to rotate upwardly the sand will fall back away from the lips and cascade down over the inner drum. Because of their orientation, the vanes function to retard flow of sand moving through the annular passage 77 surrounding the inner drum from left to right in FIG. 1A.

As shown in FIG. 1B, the feed tube 40 has attached to the exterior wall surface thereof a plurality of flights or blades 86. The blades 86 extend radially outwardly from the tube wall for engaging material flowing through an annular flow passage 87 formed between the feed tube and outer drum 12. Because the feed tube is substantially smaller in diameter than the inner drum 38, the annular flow passage 87 has a cross-sectional area considerably larger than the cross-sectional area of the annular flow passage 77 surrounding the inner drum 38. Consequently, the blades 86, which extend radially outwardly from the feed tube to a point closely adjacent the interior wall surface of the outer drum 12, have substantially greater surface area exposed to hot gases passing through the annular chamber 87 than the blades 82 and 83. This promotes efficient extraction of heat from the hot gases passing through the annular chamber 87 for conduction along the blades 86 to the inner tube for preheating the sand being fed through the inner tube. Also, the blades 86 extract heat from sand flowing through the annular chamber 87 when they engage the sand. As shown, the blades 86 preferably are sloped in relation to a plane perpendicular to the axis of the outer drum 12 and are oriented such that they function to retard flow of the sand through the annular passage 87. Blade 86 also retards flow of gas through annular passage 87 which increases gas flow turbulence and this aids in achieving complete combustion of organic compounds in the gas. Hence, the blades may be designated herein as vanes which are configured similar to the blade shown in FIGS. 6 and 7, although of relatively longer radial length. As viewed in FIG. 1B, sand flows through the annular passage 87 from left to right.

As heat is extracted from the hot gases and sand passing through the flow passage 87, the hot gases and sand is correspondingly cooled.

The hot gases and sand flow from the annular passage 87 into an outlet section of the outer drum indicated generally at 90 in FIG. 1B. The outlet section 90 has a flange 91 mounted by suitable fasteners to the flange 24 on the outer drum cylinder 14 and at its opposite end the flange 41 to which a flange 92 of an end wall assembly 93 is mounted by suitable fasteners. The outlet section 90 includes a plurality of circumferentially spaced apart outlet ports 96. The portion of the outlet section 90 containing the outlet ports 96 is surrounded by a hood 97 which also is illustrated in FIG. 5 as well as in FIG. 1B. The hood 97 has a bottom discharge outlet 98 through which the thermally processed sand exits the system. The hood 97 also has at its upper end a gas discharge outlet 99 through which the hot gases are exhausted. The exhaust gases preferably are passed through an indirect heat exchanger 102 for heating supply air that is directed via duct 103 to the gas burner 63. In this manner the supply air is preheated and the exhaust gases are further cooled prior to passage to the atmosphere preferably via a bag house which includes a draft fan for creating negative pressure in the interior of the system 10.

Figure 8:
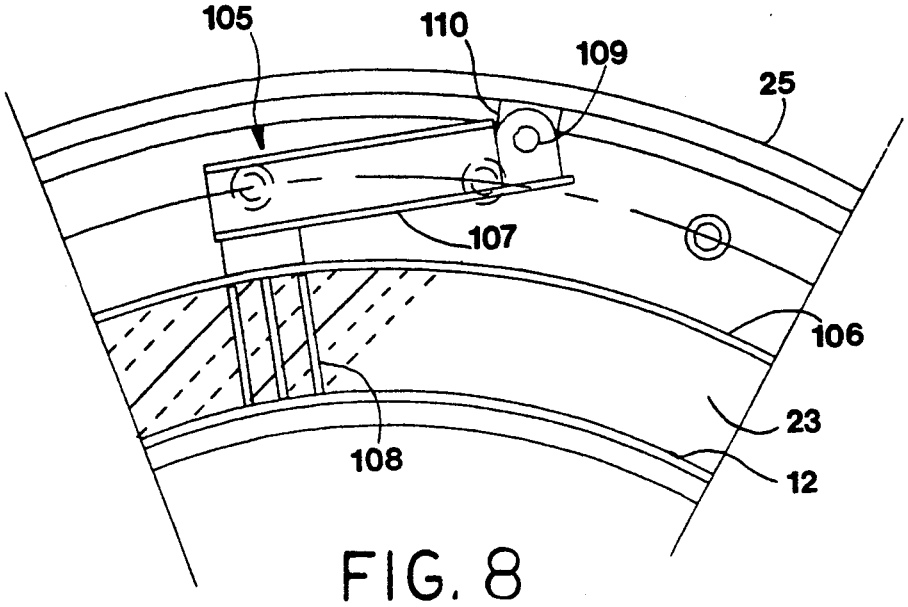
FIG. 8 is a fragmentary cross-sectional view taken along the line 8—8 of FIG. 1A.

Referring now to FIG. 8, the manner in which the riding ring 25 is mounted to the outer drum 12 is illustrated, such illustration and the following description being equally applicable to the riding ring 26. The riding ring 25 is mounted to the outer drum by a plurality of circumferentially spaced apart pivoting strut assemblies, a representative one of which is designated generally by reference numeral 105 in FIG. 8. In the region of the outer drum 12 that is circumscribed by the riding ring 25 there is attached as by welding to the adjacent flange 23 an outer mounting ring 106. Each pivoting strut assembly 105 has an L-shape strut 107 having a short leg attached as by welding to the outer ring 106 at a point reinforced by radial rib plates 108. The long leg of the strut 107 is pivotally attached at its distal end by a pin 109 to a lug 110 attached as by welding to the interior surface of the riding ring 25. With this arrangement, the strut assemblies 105 mount the riding ring 25 to the outer drum 12 while permitting thermal expansion and contraction of the outer drum 12 relative to the riding ring 25 as may occur during heat up and cool down of the system.

Figure 9:
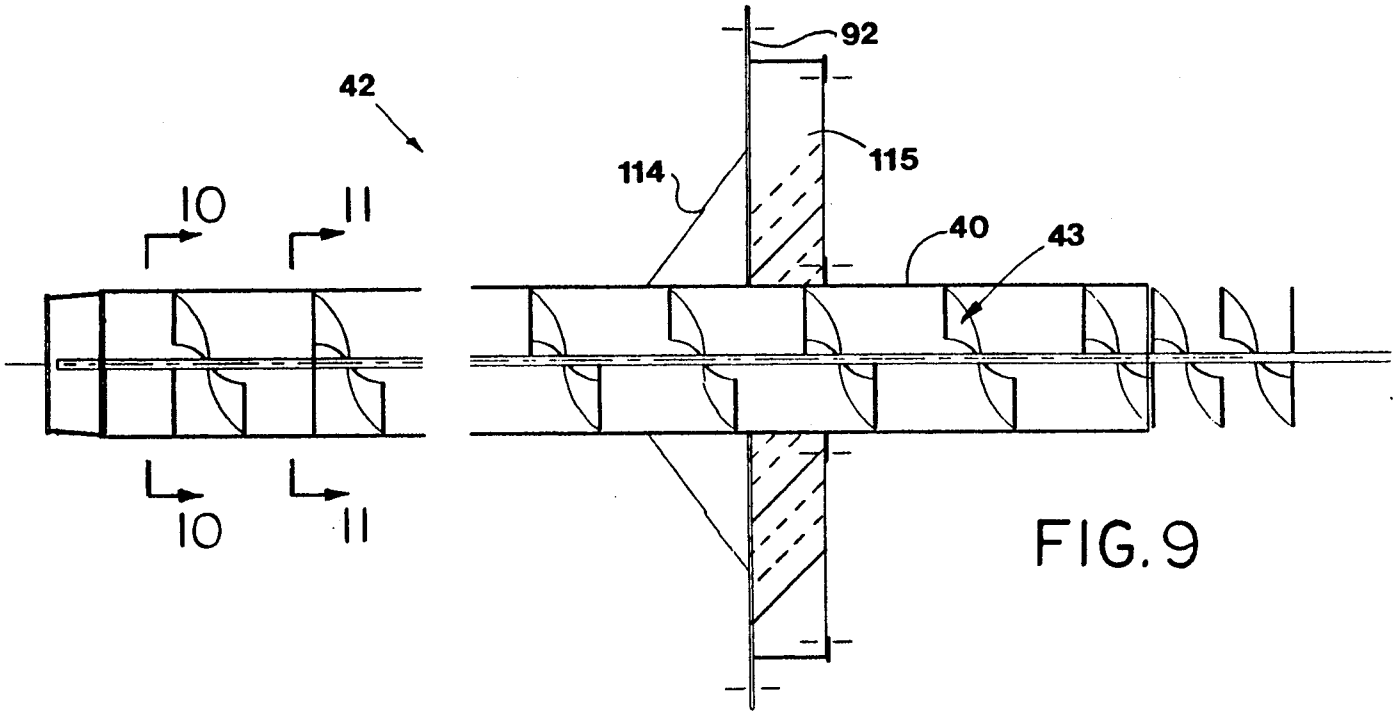
FIG. 9 is a cross-sectional view of the material conveyor used in the system.
Figure 10:
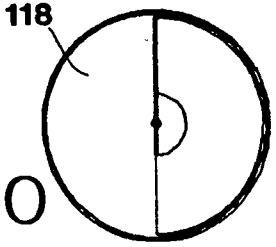
FIG. 10 is a cross-sectional view taken along the line 10—10 of FIG. 9.
Figure 11:
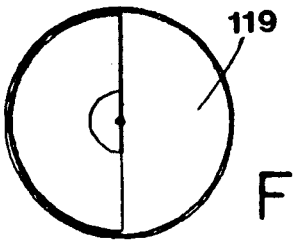
FIG. 11 is a cross-sectional view taken along the line 11—11 of FIG. 9.

Referring now to FIGS. 9–11, the material conveyor 42 is further illustrated. The conveyor assembly 42 includes the end plate 92 which is attached to the feed tube 40 and reinforced by triangular gussets 114. On the outer side of the end plate 92 there is provided one or more layers of insulation 115. Similarly, one or more layers of insulation 116 is provided on the outer side of the end wall 78 closing the opposite end of the outer drum 12 as seen at the left in FIG. 2. The insulations 115 and 116 provided at the end of the outer drum and the insulations 17 and 18 surrounding the outer drum function as an insulating jacket for minimizing the escape of heat from the system to the atmosphere. The end wall 92 is preferably removably attached by suitable fasteners to the flange 41.

As further seen in FIG. 9 and with additional reference to FIGS. 10 and 11, the last two turns of the feed screw 43 have associated therewith semi-circular flow retarding plates 118 and 119. The plates 118 and 119 are provided to increase the residence time of the material being fed through the feed tube particularly in the area surrounded by the annular chamber 87 thereby to enhance the preheating of the incoming sand.

Preferably, the feed screw 43 is slightly smaller in diameter than the inner diameter of the feed tube 40 so that the feed screw can be inserted axially into the feed tube. The feed screw may then be tack welded at its accessible inlet end to the feed tube so that it will rotate with the feed tube during the rotation of the inner and outer drums. In the event there is a need to remove the feed screw from the feed tuve such as for repair purposes, the accessible welds may be broken and the feed screw removed from the feed tube. It also is noted that the conveyor assembly 42 may be easily removed from the outer drum by demounting the end wall 92 from the flange 41, followed by axially withdrawal of the conveyor assembly from within the outer drum 12.

The operation and methodology of the invention will now be described chiefly with reference to FIG. 12 which is a process flow diagram. In operation, the outer drum is rotated as are the inner drum, feed tube and feed screw with the outer drum. During such rotation, spent foundry sand will be fed from the hopper 48 through the feed tube 40 and into the inner drum 38. The sand exiting the feed tube will fall on to the bottom of the inner drum where it will build up and be engaged initially by the first circumferential rows of paddles 66 (FIG. 2). As the inner drum turns the paddles lift the sand upwardly. As the paddles continue to rotate upwardly the sand will fall off and flow downwardly through the hot gases being injected towards the inlet end of the inner drum by the heater tube 57. As sand builds up at the inlet end of the inner drum it will tend to flow to the left in FIG. 12 and progressively into engagement with the following circumferential rows of vanes and paddles. The vanes function to retard the flow while the paddles primarily function to lift the sand and allow it to flow downwardly through the hot gases in the inner drum. As illustrated in FIG. 2, there are two adjacent rows of paddles located axially adjacent the outlet end of the heater tube 57 thereby to maximize the contact of the sand with the hot gases entering the inner drum. This heating and mixing action will operate to calcine the sand thereby to rid the sand of organic binders and the like.

Figure 12:
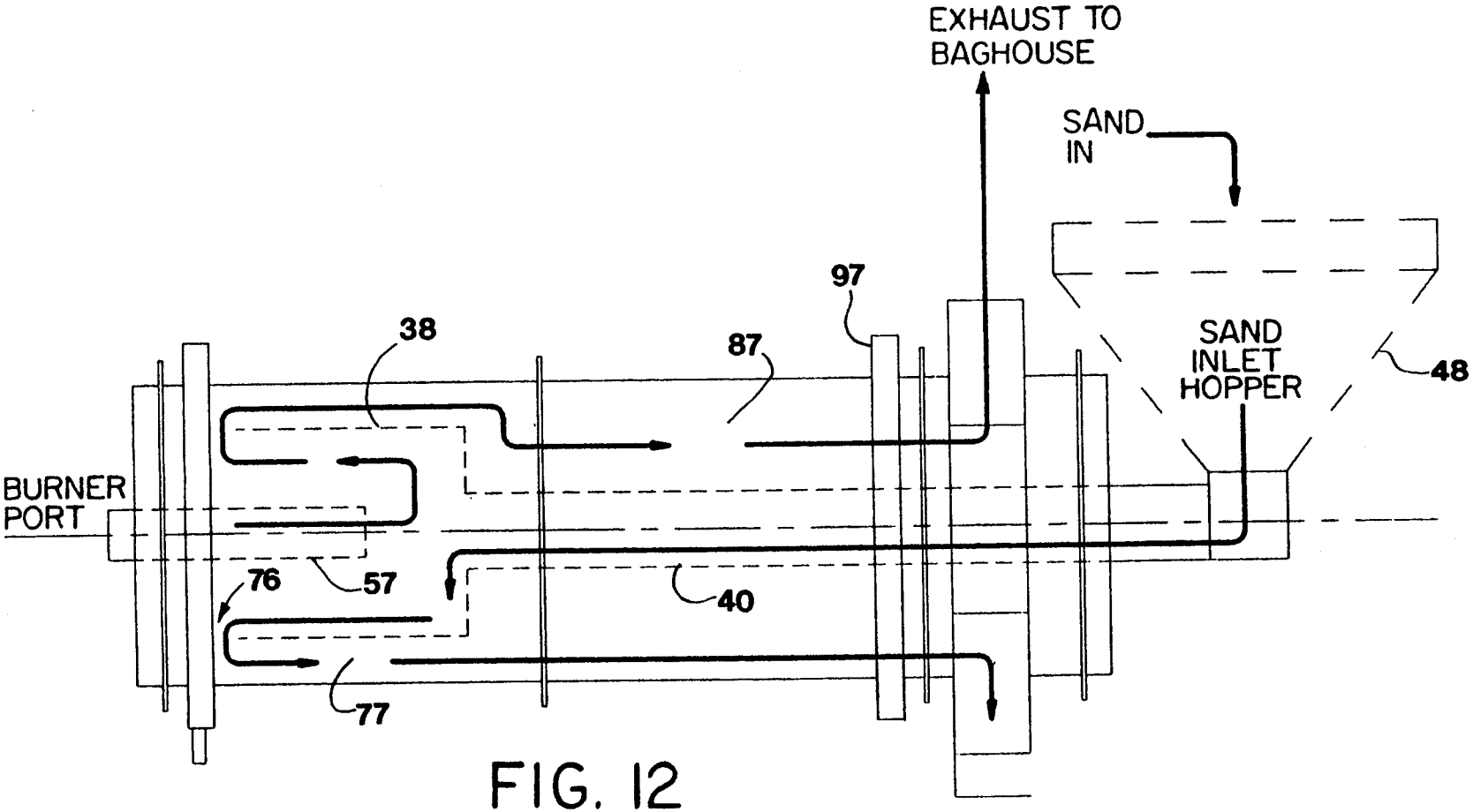
FIG. 12 is a thermal sand reclamation process flow diagram according to the invention.

As sand continues to be fed into the inner drum, sand will flow from right to left in FIG. 12 as it continues to be subjected to the agitation action of the paddles and vanes. When the sand is axially coextensive with the heater tube 57, the sand falling from the paddles will cascade over the heater tube which will be at a relatively high temperature in view of the hot gases being passed therethrough. As the hot gases exit the burner tube, they will reverse direction in the inlet end of the heater drum and flow from right to left in FIG. 12 further making contact with the sand that also is moving from right to left in FIG. 12. As the sand reaches the heater end of the inner drum it will drop through the annular outlet passage 76 for counterflow through the annular flow passage 77. As the sand moves through the annular flow passage 77 it will lift the sand up and it cascade it down over the inner drum to continue uniform heating of the sand and burn off of carbonaceous material. Also, the vanes moving through the annular flow passage 77 will operate to further agitate the sand and retard its flow to increase the residence time of the sand in the high temperature region of the system.

The hot gases also will flow out of the inner drum through the annular outlet passage 76 and then through the annular flow passage 77. The hot gases then flow into the annular flow passage 87 where the hot gases come into contact with the blades attached to the feed tube 40. The blades, being at an angle, require the exhaust gases to work their way around them and thereby generates turbulence within the annular flow passage 87 to ensure complete combustion. The blades also function to extract heat from the exhaust gases which heat is conducted to the feed tube 40 for preheating the incoming sand being fed through the feed tube 40. The blades also function to retard flow of sand through the annular flow passage 87 and to extract heat flowing through the annular flow passage 87 from left to right in FIG. 12.

After traversing the annular flow passage 87 the sand moves to the outlet section where it exits through the then downwardly disposed outlet port for discharge to a bottom outlet of the hood 97. The exhaust gases will also move into the outlet section and exit through the outlet port for passage through the heat exchanger 102 for preheating air supplied to the gas burner 63 (FIG. 1). The exhaust gases may then be exhausted to the atmosphere preferably via a bag house for removing any particulate material that may be entrained in the exhaust gas.

By way of specific example, the outer drum may have an overall length of about 19 feet and a diameter of about five feet. More particularly, each cylindrical section of the outer drum may have a length of about 90 inches and the outlet section may have a length of about 36 inches. The inner drum may have a diameter of about 40 inches and a length of about 80 inches. As for the feed tube, it may have a diameter of about 17 inches and a length of about 176 inches.

A system having components of the aforedescribed size may be operated at a drum rotation speed of from two to four revolutions per minutes. Also, the gas burner may be operated to generate hot gases at a temperature preferably ranging from 800° to 1500° F. For recycling spent foundry sand, preferably the hot gases are entering the inner drum at a temperature of at least 1300° F. to ensure complete combustion of volatile organic compounds contained in the spent foundry sand. The sand may have an overall residence time of about 55 minutes of which about 20–25 minutes is in the inner drum and the rest is in the outer drum or being fed through the feed tube.

The various components of the system may be made of any suitable material. For example, the major components may be fabricated from an alloyed carbon steel such as, for example, ASTM 387, grade 11 material which is suitable for use in gas fired equipment. Also, the outer drum may be jacketed with about six inches thick insulation.

Although the invention has been shown and described with respect to a preferred embodiment, it is obvious that equivalent alternations and modifications will occur to others skilled in the art upon the reading and understanding of this specification. The present invention includes all such equivalent alterations and modifications, and is limited only by the scope of the following claims.

What is claimed is:

1. A system for thermally treating solid, granular and aggregate material, comprising:

a base;

an outer drum mounted on said base for rotation about a rotational axis and having an inlet end, a heater end and an annular wall extending between said inlet and heater ends;

an inner drum mounted coaxially within said outer drum closer to said heater end than said inlet end of said outer drum, said inner drum having an inlet end, a heater end and an annular wall extending between said inlet and heater ends, said annular wall being spaced radially inwardly from said annular wall of said outer drum to form an annular flow passage surrounding said inner drum, said annular flow passage surrounding said inner drum having an inlet end and an outlet end;

passage means at said heater end of said inner drum for allowing material to drop from said inner drum into said outer drum for flow through said annular flow passage from its inlet end to its outer end;

means for rotating said outer and inner drums with respect to said base;

material conveying means for conveying material from said inlet end of said outer drum to said inner drum for deposit within the interior of said inner drum at its inlet end, said material conveying means including a feed tube through which the material is fed, said feed tube being mounted coaxially within said outer drum and extending from said inlet end of said outer drum to said inlet end of said inner drum, said feed tube being spaced radially inwardly from said annular wall of said outer drum to form an annular flow passage surrounding said feed tube, said annular flow passage surrounding said feed tube having an inlet end connected to said outlet end of said annular passage surrounding said inner drum, an outlet end, and a cross-sectional area greater than the cross-sectional area of said annular passage surrounding said inner drum;

means for generating and feeding hot gases into said inner drum for contacting with material fed into said inner drum by said material conveying means thereby to thermally treat the material, said hot gases flowing through said inner drum, then through said annular passage surrounding said inner drum and then through said annular passage surrounding said feed tube; and outlet means for exhausting the hot gases and discharging thermally treated material from said outlet end of said annular passage surrounding said feed tube.

2. A system as set forth in claim 1, wherein said material conveying means includes a feed screw extending through said feed tube substantially along the length of said feed tube.

3. A system as set forth in claim 2, wherein said feed screw and feed tube are coupled for rotation with said outer and inner drums.

4. A system as set forth in claim 2, comprising a hopper having a discharge chamber at its bottom end located at an inlet end of said feed tube, and wherein said feed screw extends into said discharge chamber for capturing material for transport along said feed tube to said inner drum.

5. A system as set forth in claim 4, wherein said feed screw has a first section axially coextensive with said discharge chamber and a second section axially coextensive with said feed screw, said feed tube is circular in cross-section and has an inner diameter, said second section has a fixed pitch length and an outer diameter substantially the same as the inner diameter of said feed tube, and said first section has a pitch length less than the pitch length of said second section and an outer diameter less than said outer diameter of said second section.

6. A system as set forth in claim 2, wherein said inner drum has at its inlet end an inlet end wall having a center opening, and said feed tube extends through and has a fit within said center opening that permits at least limited relative axial movement.

7. A system as set forth in claim 1, wherein said means for generating and feeding hot gases into said inner drum includes a hot gas tube extending coaxially into said inner drum from said heater end of said drum for directing the hot gases into said inner drum, said hot gas tube extending at least halfway into said inner drum.

8. A system as set forth in claim 1, wherein said feed tube is coupled for rotation with said outer and inner drums and has attached thereto a plurality of circumferentially and axially spaced apart, radially outwardly extending flights having material engaging surfaces for contacting the material flowing through said annular passage surrounding said feed tube as said flights rotate around the axis of said feed tube.

9. A system as set forth in claim 8, wherein said plurality of flights include a plurality of vanes having the material engaging surfaces thereof sloped relative to a plane perpendicular to the axis of said feed tube.

10. A system as set forth in claim 9, wherein said vanes have at their radially outer ends lips projecting forwardly of said material engaging surfaces for capturing material as said paddles rotate.

11. A system as set forth in claim 9, wherein said vanes are circumferentially spaced apart in respective circumferential rows axially spaced apart along the axis of said feed tube.

12. A system as set forth in claim 9, wherein said vanes are sloped to retard flow of material through said annular space surrounding said feed tube during rotation of said outer and inner drums.

13. A system as set forth in claim 8, wherein said flights and feed tube function to extract heat from the hot gases and material flowing through said annular passage surrounding said feed tube and transfer it to material being fed through said feed tube to said inner drum.

14. A system as set forth in claim 1, wherein inner drum has attached thereto a plurality of circumferentially and axially spaced apart, radially outwardly extending flights having material engaging surfaces for contacting the material flowing through said inner drum as said flights rotate around the axis of said inner drum.

15. A system as set forth in claim 14, wherein said flights have at their radially inner ends lips projecting forwardly of said material engaging surfaces for capturing material as said paddles rotate.

16. A system as set forth in claim 14, wherein said plurality of flights include a plurality of paddles having the material engaging surfaces thereof oriented parallel to the axis of said inner drum and a plurality of vanes having the material engaging surfaces thereof sloped relative to a plane perpendicular to the axis of said feed tube.

17. A system as set forth in claim 1, wherein said inner drum has attached thereto a plurality of circumferentially and axially spaced apart, radially outwardly extending flights having material engaging surfaces for contacting the material flowing through said annular passage surrounding said inner drum as said flights rotate around the axis of said inner drum.

18. A system as set forth in claim 17, wherein said plurality of flights include a plurality of paddles having the material engaging surfaces oriented parallel to the axis of said inner drum and a plurality of vanes having the material engaging surfaces thereof sloped relative to a plane perpendicular to the axis of said inner drum.

19. A system as set forth in claim 18, wherein said paddles have at their radially outer ends lips projecting forwardly of said material engaging surfaces for capturing material as said paddles rotate.

20. A system as set forth in claim 1, wherein said outlet means includes a plurality of circumferentially spaced apart outlet openings in an outlet section of said outer drum, and an exhaust hood surrounding said outlet section and within which said outlet section relatively rotates, said exhaust hood including a gas discharge port and a bottom material discharge port.

21. A system as set forth in claim 1, including means for supplying feed air to said heater means, and heat exchanger means connected between said means for supplying feed air and said outlet means for indirect transfer of heat from hot gases exiting said outlet means to air being supplied to said heater means.

* * * * *